US006047537A

United States Patent [19]

Beckmann et al.

[11] Patent Number: 6,047,537

[45] Date of Patent: Apr. 11, 2000

[54] METHOD FOR PRODUCING A TWISTED YARN BY AN INTEGRATED SPINNING AND TWISTING PROCESS ACCORDING TO THE TWO-FOR-ONE PRINCIPLE AS WELL AS DEVICE FOR PERFORMING THE METHOD

[75] Inventors: Markus Beckmann, Krefeld; Roland Greis, Tönisvorst; Stefan Kross, Viersen; Wilfried Ruetten, Wegberg; Guido Spix, Kaarst, all of Germany

[73] Assignee: Volkmann GmbH & Co., Germany

[21] Appl. No.: 09/260,520

[22] Filed: Feb. 25, 1999

[30] Foreign Application Priority Data

Feb. 25, 1998 [DE] Germany ..... 198 07 981

[51] Int. Cl.[7] ..... D01H 4/00

[52] U.S. Cl. ..... 57/404; 57/58.49; 57/408

[58] Field of Search ..... 57/58.52, 58.7, 57/58.83, 400, 404, 406, 408, 409, 411, 413

[56] References Cited

U.S. PATENT DOCUMENTS 5,479,771 1/1996 Ballhausen et al. ..... 57/406

5,626,011 5/1997 Ballhausen et al. ..... 57/409

5,628,177 5/1997 Ballhausen et al. ..... 57/406

FOREIGN PATENT DOCUMENTS 4427875 8/1994 Germany .

*Primary Examiner*—William Stryjewski

*Attorney, Agent, or Firm*—Robert W. Becker & Associates

[57] ABSTRACT

In a method for producing a twisted yarn by an integrated spinning and twisting process, individual spun yarns are spun from loose fiber material in at least two spinning devices. The spun yarns are combined and guided in a first direction and subjected to a common first twisting to form a once twisted yarn. The once twisted yarn is then guided in a second direction opposite the first direction according to the two-for-one twisting principle, to form a yarn balloon in order to subject the once twisted yarn to a second twisting. The resulting yarn is then fed through a centering point to a winding device. The loose fiber material is fed into the annular chamber, that is coaxial to the yarn balloon and in which the yarn balloon freely rotates, and is guided substantially radially through the yarn balloon such that the yarn of the yarn balloon directly passes through the loose fiber material. The loose fiber material is then conveyed from the annular chamber substantially radially inwardly into the spinning devices by a pressure gradient.

11 Claims, 2 Drawing Sheets

METHOD FOR PRODUCING A TWISTED YARN BY AN INTEGRATED SPINNING AND TWISTING PROCESS ACCORDING TO THE TWO-FOR-ONE PRINCIPLE AS WELL AS DEVICE FOR PERFORMING THE METHOD

BACKGROUND OF THE INVENTION

The present invention relates to a method for producing a twisted yarn by an integrated spinning and twisting process according to the two-for-one principle wherein with two adjacently positioned spinning devices individual spun yarns are produced which are combined and then subjected to a common twisting process and, subsequently, are then guided in the opposite direction, according to the two-for-one principle, under formation of a yarn balloon rotating about the spinning devices to a centering point above the spinning devices and to a winding device. Each spinning device is supplied with loose fiber material fed in a substantially radial direction through the yarn balloon. The fiber material is first guided in the radial direction to an annular chamber extending coaxially to the axis of the yarn balloon in which the yarn balloon is guided. Subsequently, the loose fiber material is guided under the effect of a pressure gradient in a substantially radial direction out of the annular chamber and to the spinning devices. The corresponding device has the aforementioned structural features.

Such a device and method are known from German Patent application 44 27 875.

In the method and device known from this publication, the loose fiber material is first guided via fiber feed channels to an annular chamber that is arranged coaxially to the spindle axis. The yarn forming the yarn balloon is guided through this annular chamber such that it rotates through the annular chamber within a column or spoke that is part of the rotating component so that the yarn forming the yarn balloon does not come into direct contact with the supplied fiber material. This construction is based on the prejudice that the fiber stream and the rotating yarn should not interfere with one another. The column or spoke though which the yarn is guided can be designed such that no fibers will attach to it. In one embodiment for performing this invention, the rotating component which comprises the yarn guide element, in which the yarn is guided within the yarn balloon, is embodied as a pot that is fixedly connected to the spindle rotor. It has at its upper end two annular components positioned opposite one another in the axial direction which delimit therebetween the annular chamber. The two annular parts are connected to one another by spoke-like connecting elements which penetrate the annular chamber whereby the yarn guide element is arranged in one of the connecting elements.

In principle, such a connecting element containing the yarn guide element at the circumference of the pot would be sufficient for guiding the yarn through the annular chamber. However, this is disadvantageous with regard to machine-technological considerations because of the resulting imbalance. It is therefore more desirable to have at least two, preferably three, such spoke-like connecting elements distributed about the circumference. However, this has the consequence that the fiber stream for each spindle rotation would be subjected to three disruptions. Since the connecting elements, because of constructive reasons, have a certain minimum width in the circumferential direction, even for a flow-technologically optimized contour of the connecting elements, individual fibers will be removed from the fiber stream and a fiber disorientation will result.

Furthermore, it has been shown that the connecting elements between the annular parts of the pot are also a source of high noise emission. They act, despite advantageous flow contours, like a siren whose sound, despite an encapsulated embodiment, still penetrates to the exterior with an unacceptable noise level.

It is therefore an object of the present invention to embody a method and a device of the aforementioned kind such that during supply of the fiber material a minimal fiber disorientation will result and the noise emission is considerably reduced.

SUMMARY OF THE INVENTION

As a solution to this object it is suggested that the yarn forming the yarn balloon rotates freely within the area of the annular chamber so that the fiber material supplied thereto will directly penetrate the yarn balloon. In respect to the device it is suggested that the annular chamber, when viewed in the direction of yarn travel, is delimited at the yarn inlet side by the free upper end of the rotating component so that the yarn forming the yarn balloon will freely rotate within the annular chamber, and that the annular chamber at the upper end (the yarn exit side in the yarn travel direction) is delimited by an annular gap of a predetermined width.

The basic idea of the invention is that the yarn forming the yarn balloon should rotate freely, i.e., without being guided by an enclosing yarn guide element, through the annular chamber. The fiber stream of loose fiber material is still introduced into the annular at a transverse direction to the yarn travel direction. In contrast to the known method the yarn forming the yarn balloon will penetrate the loose fiber stream without being protected. It was surprisingly found that this unprotected guiding of the yarn through the annular chamber is not only possible but will even result in a substantially reduced interruption of the fiber stream. The result is a substantially improved twisted yarn with respect to textile technological properties, and, also, the fiber substance yield is substantially higher. Furthermore, the noise emission is considerably reduced. As an additional advantage it was found that a device operating according to the inventive method can be constructed with a reduced height in comparison to known devices. This is so because the annular parts, delimiting the annular chamber and extending in the axial direction, are no longer needed. The yarn can be directly guided out of the annular chamber through an annular gap that delimits the annular chamber at the yarn exit side with and has a width of approximately 4 mm, to the centering point.

The invention opens up a further possibility to reduce the fiber disorientation when supplying the fiber material. For feeding the fiber material, the annular chamber is supplied with vacuum. The vacuum flow, from the annular chamber, can be guided, on the one hand, into the fiber feed channels and, on the other hand, into an exit chamber positioned at the fiber exit side of the annular chamber between the upper side of the inner housing and the cover of the outer housing comprising the centering opening. This results in an air flow from this chamber through the annular gap into the annular chamber. This air flow has the tendency to return disoriented fibers, which have entered this chamber or the annular gap, into the annular chamber so that there is a great probability of a new orientation of these disoriented fibers. In order to provide an improved control possibility of the air flow, it is expedient to guide the vacuum flow, generated by the vacuum source connected to the hollow spindle axle, directly to the annular chamber without a bypass into the outer space. A sealing of the annular chamber with respect to the vacuum must be provided only with respect to the yarn inlet side, i.e., in the downward direction.

In sum total, this results in an improved division of the inner spaces of the twisting spindle being under vacuum with respect to those at higher pressure which allows optimal adjustment of the negative pressure gradient required for the fiber transport. The vacuum flow, in contrast to known methods, is not only guided from the annular chamber into the fiber feed channel but also through the annular gap and the opening at the centering point of the yarn balloon. The desired adjustment of the vacuum flow can then be performed at this location in a simple, manner, for example, by a throttle effect.

BRIEF DESCRIPTION OF THE DRAWINGS

The object and advantages of the present invention will appear more clearly from the following specification in conjunction with the accompanying drawings, in which.

DESCRIPTION OF THE PREFERRED EMBODIMENTS

The present invention will now be described in detail with the aid of several specific embodiments utilizing FIGS. 1 and 2.

Figure 1:
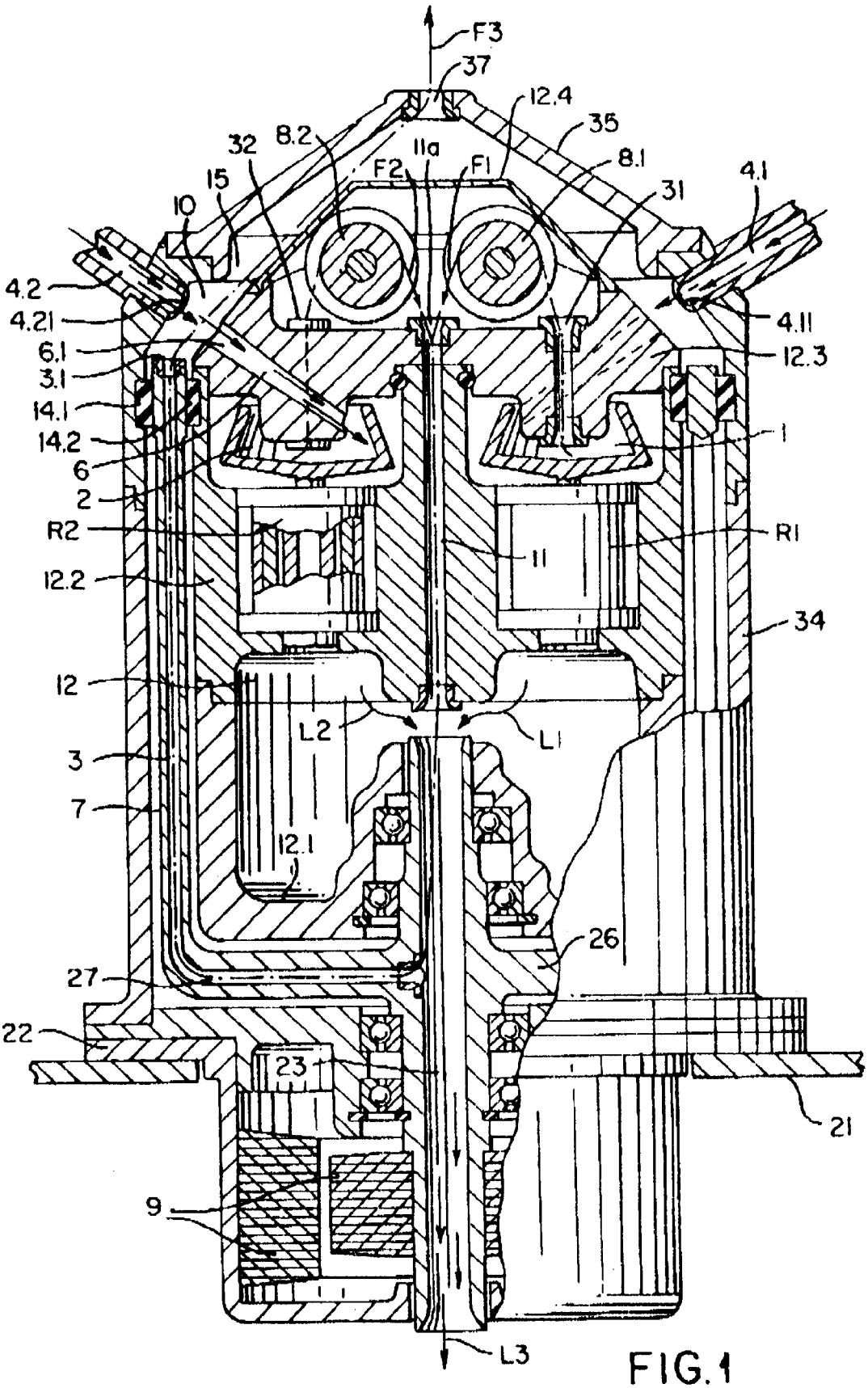
FIG. 1 is a sectional view of the two-for-one spinning and twisting spindle with integrated spinning devices in the form of spinning rotors.
Figure 2:
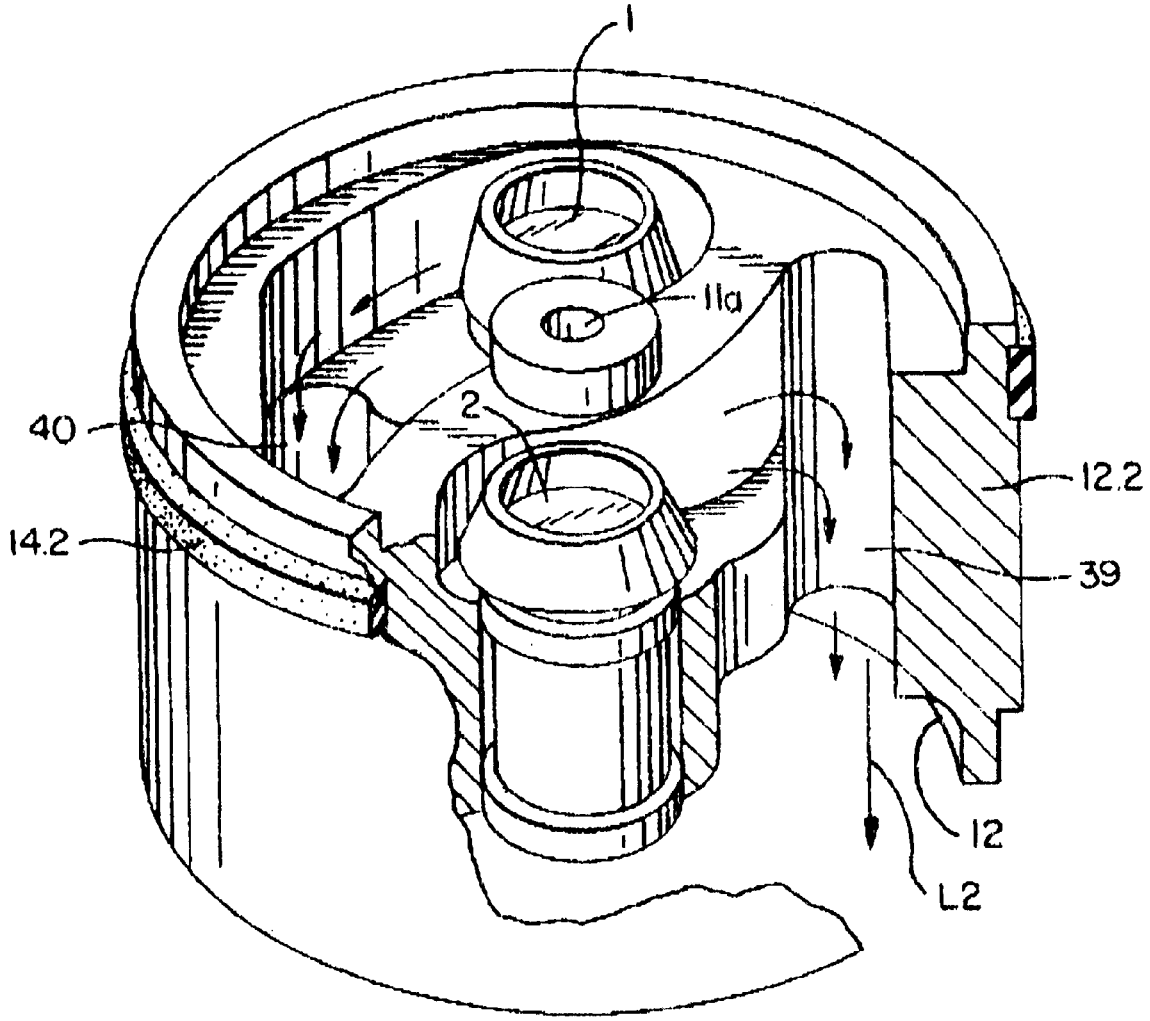
FIG. 2 is an enlarged perspective view of a detail of FIG. 1 showing the twisting spindle according to FIG. 1 in the area of the spinning rotors.

FIG. 1 shows a two-for-one spinning and twisting spindle. A hollow shaft 23 is rotatably supported in a spindle bank 21, which is representative of the machine frame, by a bearing block 22. Its outer end, in the representation the lower end, is to be connected to a non-represented vacuum source. The hollow shaft 23 driven by a motor 9 supports a radially outwardly oriented spindle rotor disc 26 with a substantially radially extending yarn guide channel 27. To the outer circumference of the spindle rotor disc 26 a twisting pot 7 is connected having in its wall a yarn guide element or yarn guide tube 3 extending in the upward direction and connected with its lower end to the yarn guide channel 27. The yarn F3 exits from its upper end and is guided through the annular chamber 10, which will be described in the following, to the centering point 37.

At the upper end of the hollow shaft 23 a spinning pot 12 is supported with interposition of suitable bearings. The spinning pot 12 is substantially closed and secured against rotation by nonrepresented permanent magnets. The spinning pot 12 (inner housing) is substantially cylindrical with a bottom 12.1, an outer wall 12.2, and a removable cover 12.3. Two rotary spinning devices R1 and R2 are housed in the spinning pot 12 and are driven by spinning rotors 1 and 2. Fiber conveying channels are guided through the cover 12.3 into the spinning rotors 1 and 2, whereby in FIG. 1 only the conveying channel 6 is visible. Yarn removal tubes 31 and 32 are guided through the cover 12.3 coaxially to and above the rotor axis of the spinning devices through which the spun yarns F1, F2 produced by the spinning rotors 1 and 2 are removed in the upward direction before they are introduced, after being guided across the starting wheels 8.1 and 8.2, through the upper inlet 11*a* into the downwardly oriented hollow spindle axle 11.

Vacuum (arrow L3) is produced in the interior of the inner housing 12 through the hollow shaft 23 which acts through the air channels 39, 40 (see FIG. 2; arrows L1 and L2 in FIG. 1) in the area of the spinning rotors 1 and 2 and thus in the conveying channel 6 and causes the fiber transport into the spinning rotors 1 and 2.

The spinning pot 12 and the twisting pot 7 are enclosed by an outer housing 34 having a removable cover 35. At the upper side of the cover 35 of the outer housing 34 a yarn exit opening 37 is provided as a centering point that is coaxial to the hollow shaft. A winding device for the twisted yarn F3 is arranged downstream thereof.

The cover 12.3 of the spinning pot 12 has at its upper side a top 12.4 that seals the interior of the spinning pot 12 relative to the exit chamber between the upper side of the spinning pot 12 and the cover 35 of the outer housing 34. Without such a top 12.4 a bypass for the vacuum flow in the annular chamber 10 and the annular gap 15 would result.

Fiber feed channels 4.1 and 4.2 are arranged in the outer housing 34 for supplying fiber material to the device, whereby the channels 4.1 and 4.2 have outlets 4.11 4.21 opening into the annular chamber 10. The outlets have correlated therewith inlets of the fiber conveying channels whereby only the inlet 6.1 is shown in FIG. 1. The annular chamber 10 is delimited, on the one hand, by the inner wall of the outer housing 34 and the outer wall of the inner housing 12 and is further delimited at its lower end, i.e., the yarn inlet side, by the upper end of the twisting pot 7 (rotary component). The upper end of the twisting pot 7 is guided between sealing rings 14.1 and 14.2 which seal the annular chamber 10 relative to the space below that is at a higher pressure. At the upper yarn exit side, the annular chamber 10 is connected by an annular gap 15 to the exit chamber below the cover 35. The fiber material is supplied to the annular chamber 10 by non-represented opening devices for fiber material via the fiber feed channels 4.1 and 4.2. It is then guided via the fiber conveying channels 6 by the supplied vacuum to the spinning rotors 1 and 2. The yarns F1 and F2 produced therein are guided across the starter wheels 8.1 and 8.2 and are then supplied to the hollow spindle axle 11 for imparting the first twist. For imparting the second twist the once twisted yarns are then guided through the yarn guide channel 27 and the yarn guide tube 3. The yarn F3 exits at the upper end of the yarn guide tube 3 through outlet opening 3.1 and enters the annular chamber 10. The yarn F3 then passes through the annular chamber 10 and, during the spindle rotation, passes through the fiber stream in an unprotected manner, i.e., without being guided in a yarn guide element. It exits the annular chamber 10 through the annular gap 15 and is guided to the centering point 37 where it is removed and then wound onto a cross spool.

The specification incorporates by reference the disclosure of German priority document 198 07 981.8 of Feb. 25, 1998.

The present invention is, of course, in no way restricted to the specific disclosure of the specification and drawings, but also encompasses any modifications within the scope of the appended claims.

What is claimed is:

1. A method for producing a twisted yarn by an integrated spinning and twisting process; said method comprising the steps of:

a) spinning individual spun yarns (F1, F2) from loose fiber material in at least two spinning devices (R1, R2);

b) combining the spun yarns (F1, F2) and guiding the spun yarns (F1, F2) in a first direction;

c) subjecting the spun yarns (F1, F2) to a common first twisting to form a once twisted yarn;

d) guiding the once twisted yarn in a second direction opposite said first direction according to the two-for-one twisting principle to form a yarn balloon and subject the once twisted yarn to a second twisting to form a twice twisted yarn (F3);

e) feeding the twice twisted yarn (F3) through a centering point (37) to a winding device;

f) feeding the loose fiber material into an annular chamber (10), that is coaxial to the yarn balloon and in which the yarn balloon freely rotates, and substantially radially through the yarn balloon such that the twice twisted yarn of the yarn balloon (F3) directly passes through the loose fiber material;

g) conveying the loose fiber material from the annular chamber (10) substantially radially inwardly into the spinning devices (R1, R2) by a pressure gradient.

2. A method according to claim 1, further including the step of arranging the location of feeding (4.21) the loose fiber material into the annular chamber (10) and the location (6.1) of conveying the loose fiber material from the annular chamber (10) radially opposite one another.

3. A method according to claim 1, further including the step of arranging the location (4.21) of feeding the loose fiber material into the annular chamber (10) and the location (6.1) of conveying the loose fiber material from the annular chamber (10) in a circumferentially staggered position in a direction of rotation of the yarn balloon.

4. A method according to claim 1, further comprising the step of applying a vacuum to the annular chamber (10), wherein the vacuum flow extends from the annular chamber (10) into feed channels for the loose fiber material and in an exit direction of the spun yarns from the at least two spinning devices (R1, R2) into an exit chamber positioned below the centering point (37).

5. A device for producing a twisted yarn, said device comprising:

a stationary outer housing (34);

a spindle rotor (9, 22) having a rotary hollow shaft (23) extending into said outer housing (34);

a stationary inner housing (12) mounted inside said outer housing (34) on said hollow shaft (23);

at least two spinning devices (R1, R2) mounted inside said inner housing (12) and having yarn removal tubes through which spun yarn is removed from each one of said spinning devices (R1, R2);

said hollow shaft (23) having a radially outwardly extending yarn guide channel (27);

a centering element (37) connected to said outer housing (34) and positioned at a spacing above said hollow shaft (23) coaxially to said hollow shaft (23);

said yarn guide channel (27) connected to said yarn guide element (3);

a rotary component (7) mounted in a space between said inner housing (12) and said outer housing (34) coaxially to said hollow shaft (23) and having a yarn guide element (3), wherein the spun yarns removed from said spinning devices are guided together into said hollow shaft (23), from there into said yarn guide channel (27) and, under formation of a yarn balloon, into said yarn guide element (3) and then to said centering element (37);

a feeding device forfeeding loose fiber material to said spinning devices (R1, R2), said feeding device comprising feed channels (4.1, 4.2) penetrating said outer housing (34) and conveying channels (6) penetrating said inner housing (12);

wherein between said outer housing (34) and said inner housing (12) an annular chamber (10) is defined into which said feed channels (4.1, 4.2) and said conveying channels (6) open;

said feed channels (4.1, 4.2) having outlets (4.11, 4.21) correlated with inlets (6.1) of said conveying channels (6);

wherein said feed device supplies the loose fiber material via said feed channels (4.1, 4.2) through the yarn balloon into said conveying channels (6);

wherein said annular chamber (10), when viewed in a direction of yarn travel from said rotary component (7) to said centering location (37) has a lower end delimited by an upper rim of said rotary component (7) and has an upper end delimited by a predetermined annular gap (15) between said inner and outer housings (12, 34) and wherein the yarn balloon rotates freely within said annular chamber (10).

6. A device according to claim 5, further comprising a vacuum source loading said annular chamber (10) with vacuum, wherein said outer housing has a cover (35) in which said centering point (37) is mounted and wherein said inner housing (12) has a closed upper side (12.3, 12.4) so that an exit chamber is defined between said cover (35) and said closed upper side (12.3, 12.4), wherein the vacuum flow extends into said feed channels (4.1, 4.2) and through said annular gap (15) into said exit chamber.

7. A device according to claim 6, wherein said vacuum source is connected to said hollow shaft (23) and wherein the vacuum flow is directly guided into said annular chamber (10) without bypass into said space between said outer housing (34) and said inner housing (12).

8. A device according to claim 7, wherein said closed upper side of said inner housing (12) has a cover (12.3) and a top (12.4), wherein said top (12.4) closes off the interior of said inner housing (12) relative to said exit chamber.

9. A device according to claim 5, wherein said rotary component (7) is a twisting pot fixedly connected to said hollow shaft (23), wherein said yarn guide element is a yarn guide tube (3) positioned in the wall of said twisting pot (7) and having a yarn exit opening (3.1).

10. A device according to claim 9, further comprising sealing rings (14.1, 14.2) mounted opposite one another in said outer housing (34) and said inner housing (12), wherein an upper end of said twisting pot (7) is guided in said sealing rings (14.1, 14.2) to seal said annular chamber (10) relative to said space between said outer and inner housings (34, 12).

11. A device according to claim 5, wherein said inlets (6.1) of said conveying channels (6) are arranged in a circumferentially staggered position relative to said outlets (4.11, 4.21) of said feed channels (4.1, 4.2) in a direction of rotation of said rotary component (7).

* * * * *